United States Patent [19]

Clark

[11] Patent Number: 4,469,172

[45] Date of Patent: Sep. 4, 1984

[54] SELF-ENERGIZING LOCKING MECHANISM

[75] Inventor: David A. Clark, Montrose, Scotland

[73] Assignee: Hughes Tool Company, Houston, Tex.

[21] Appl. No.: 462,581

[22] Filed: Jan. 31, 1983

[51] Int. Cl.[3] ..... E21B 33/04

[52] U.S. Cl. ..... 166/115; 166/134; 166/138; 166/88; 166/217; 285/141

[58] Field of Search ..... 166/115, 88, 134, 138, 166/139, 124, 125, 216, 217, 208, 210, 382, 379, 380, 89; 285/3, 4, 141, 307, 322, 323, 394, 358, 18

[56] References Cited

U.S. PATENT DOCUMENTS

| | | | |
|---|---|---|---|
| 2,754,134 | 7/1956 | Watts et al. | 166/216 |
| 2,755,864 | 7/1956 | Vaughn | 166/216 |
| 2,849,245 | 8/1958 | Baker | 285/323 |
| 2,880,806 | 5/1959 | Davis | 166/217 |
| 3,134,610 | 5/1964 | Musolf | 166/88 |
| 3,800,869 | 4/1974 | Herd et al. | 166/382 |
| 4,109,945 | 8/1978 | Manchester et al. | 285/323 |
| 4,212,487 | 7/1980 | Jones et al. | 285/323 |
| 4,330,143 | 5/1982 | Renean | 285/322 |

OTHER PUBLICATIONS

Hughes Offshore Drawing–Casing Hanger Type TF–8.

*Primary Examiner*—Stephen J. Novosad
*Assistant Examiner*—Hoang C. Dang
*Attorney, Agent, or Firm*—Robert A. Felsman; James E. Bradley

[57] ABSTRACT

A locking mechanism for securing an inner member of a well assembly to the bore of a support or outer member has features that prevent any movement of the inner member due to a force acting along the axis of the bore. The locking mechanism includes a plurality of wicker grooves formed in a sidewall of the bore transverse to the axis of the bore. Reacting grooves are formed on an outer wall of the inner member perpendicular to the axis of the bore. Slips are spaced around the outer wall of the inner member between the inner member and the sidewall of the bore. The slips each have wicker grooves on the exterior and reacting grooves on the interior. The locking mechanism includes an expansion device for moving the slips from the contracted position in which the wickers are nonengaging to an expanded position in which the wickers engage each other. The reacting grooves of the inner member each have an inclined surface facing generally outwardly and in the direction of the force. The force acting on the inner member causes the reacting grooves to transmit a resultant force to the slips to push more tightly against the bore.

7 Claims, 5 Drawing Figures

29
39
13
21
27
23
11
15
17
35
19
31
41
37
33
25

SELF-ENERGIZING LOCKING MECHANISM

BACKGROUND OF THE INVENTION

1. Field of the Invention

This invention relates in general to offshore drilling equipment, and in particular to a locking means that can be used for locking an inner tubular member within an outer tubular member, such as a casing hanger within a wellhead or a stub housing within a wellhead housing.

2. Description of the Prior Art

A typical subsea wellhead assembly includes a wellhead housing mounted within a temporary guide base that is supported on the ocean floor. Large diameter conductor pipe is secured to the wellhead housing and extends downward into the earth a short distance. A wellhead is mounted inside the wellhead housing and to a permanent guide base which mounts on top of the temporary guide base. Surface casing secured to the wellhead extends a few hundred feet down into the well. The top of the wellhead is connected to pressure equipment and risers that extend to a drilling vessel at the surface. As the well is drilled deeper, a first string or casing may be set to a certain depth. Subsequently, a second string of casing may be set.

In a typical installation, the first string of casing will locate on an annular shoulder provided in the wellhead. Cement is pumped down the first string to flow back up between the casing string and the earth formation. Then seals are actuated to seal the first string to the wellhead. The second string locates on top of the first string. As a result, downward pressure due to a pressure test on the second string bears against the first string, which transmits the force to the shoulder. This places great stress on the shoulder in the wellhead. It would be desirable to have means for independently securing the casing hangers to the wellhead, so that one casing hanger did not impose an axial force on the other casing hanger.

There are other instances, as well, where it will be useful to secure one tubular member within another tubular member so as to resist axial forces. One such instance is locating a stub housing within a wellhead housing. A stub housing is a tubular member that may be subjected to high internal forces that would exert an upward force on the stub housing, tending to force it out of the wellhead housing.

SUMMARY OF THE INVENTION

A locking means is provided for securing tubular members together, particularly an inner tubular member within an outer tubular member. This means includes placing a plurality of wicker grooves in the sidewall of the outer member. The wicker grooves are very small grooves extending circumferentially, perpendicular to the axis of the outer member. The inner member has reacting grooves formed on its outer wall. The reacting grooves are much larger and each has an inclined surface that faces generally outwardly and in the direction of the force expected to be applied to the inner member. A number of locking segments or slips are spaced around the outer wall of the inner member. Each slip has an outer wall with wicker grooves that will mate with the wicker grooves of the outer member. Each slip has an inner wall with reacting grooves that mate with the reacting grooves of the inner member.

The locking means further includes an expansion means for moving the slips from a contracted position in which the wickers of the slips are spaced inward of the wickers of the bore to an expanded position in which the wickers engage each other. In this expanded position, a force applied to the inner member will be transmitted to the reacting grooves of the slips, pushing the slips more tightly against the outer member wicker grooves to prevent the inner member from axial movement.

In one embodiment, the locking means is applied to a casing hanger which supports a string of casing in a wellhead. In this case, the reacting grooves are oriented so as to press the slips outward upon the application of a downward force. In a second embodiment, the locking means is applied to a stub housing within a wellhead housing. The reacting grooves are aligned so that an upward force will tend to push the slips further outward into tighter engagement with the outer member wicker grooves.

DESCRIPTION OF THE PREFERRED EMBODIMENT

Figure 1:
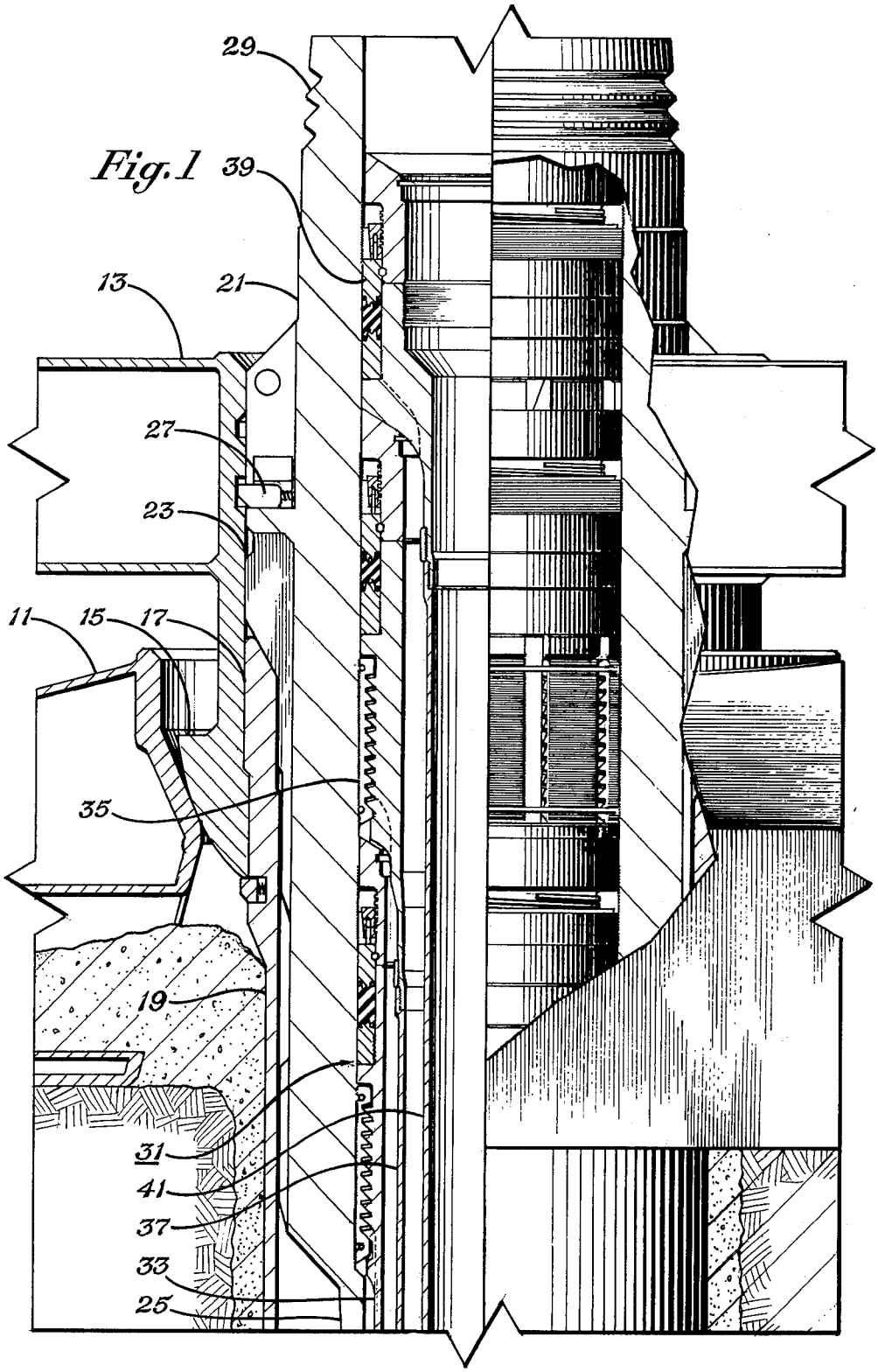
FIG. 1 is a partially sectioned view of a subsea wellhead assembly having casing hangers constructed in accordance with this invention.

Referring to FIG. 1, the subsea well assembly shown includes a temporary guide base 11 that is supported on the ocean floor. A permanent guide base 13 having flanges 15 is supported within a seat in the temporary guide base 11. A wellhead housing 17 is secured to the permanent guide base 13. Conductor pipe 19 is secured to wellhead housing 17 and extends downward into the well normally 50 to 250 feet. Conductor pipe 19 and the temporary guide base 11 are cemented into the well as indicated in the drawing.

After the conductor pipe 19 is set, the well is drilled a few hundred feet deeper, than a wellhead 21 is secured in wellhead housing 17. Wellhead 21 has flanges 23 that are supported by the top of the wellhead housing 17, and surface casing 25 is secured to the bottom of wellhead 21. Surface casing 25 extends into the well normally to a depth of 250 to 500 feet and is cemented in place. A latch 27 secures the wellhead 21 to the permanent guide base 13 to prevent any upward movement due to thermal expansion during cementing operations being encountered. Grooves 29 are located on the top of the wellhead 21 for securing to pressure equipment (not shown), which in turn is connected to risers that extend to a floating drilling vessel.

In deep wells, it may be often necessary to set more than one string of casing as the well is being drilled to avoid a large amount of the well being uncased at one time. In the drawing, a large diameter casing hanger 31 is shown mounted in wellhead 21 and secured to casing 33 which might extend to 10,000 feet, for example. A second casing hanger 35 is mounted on top of casing hanger 31 and is secured to casing 37, which might extend to the final or total depth of the well. The smallest hanger 39, shown supported on the top of casing hanger 35, supports a string 41 of pipe, which may be tubing through which the well is produced, or a smaller string of casing.

Figure 3:
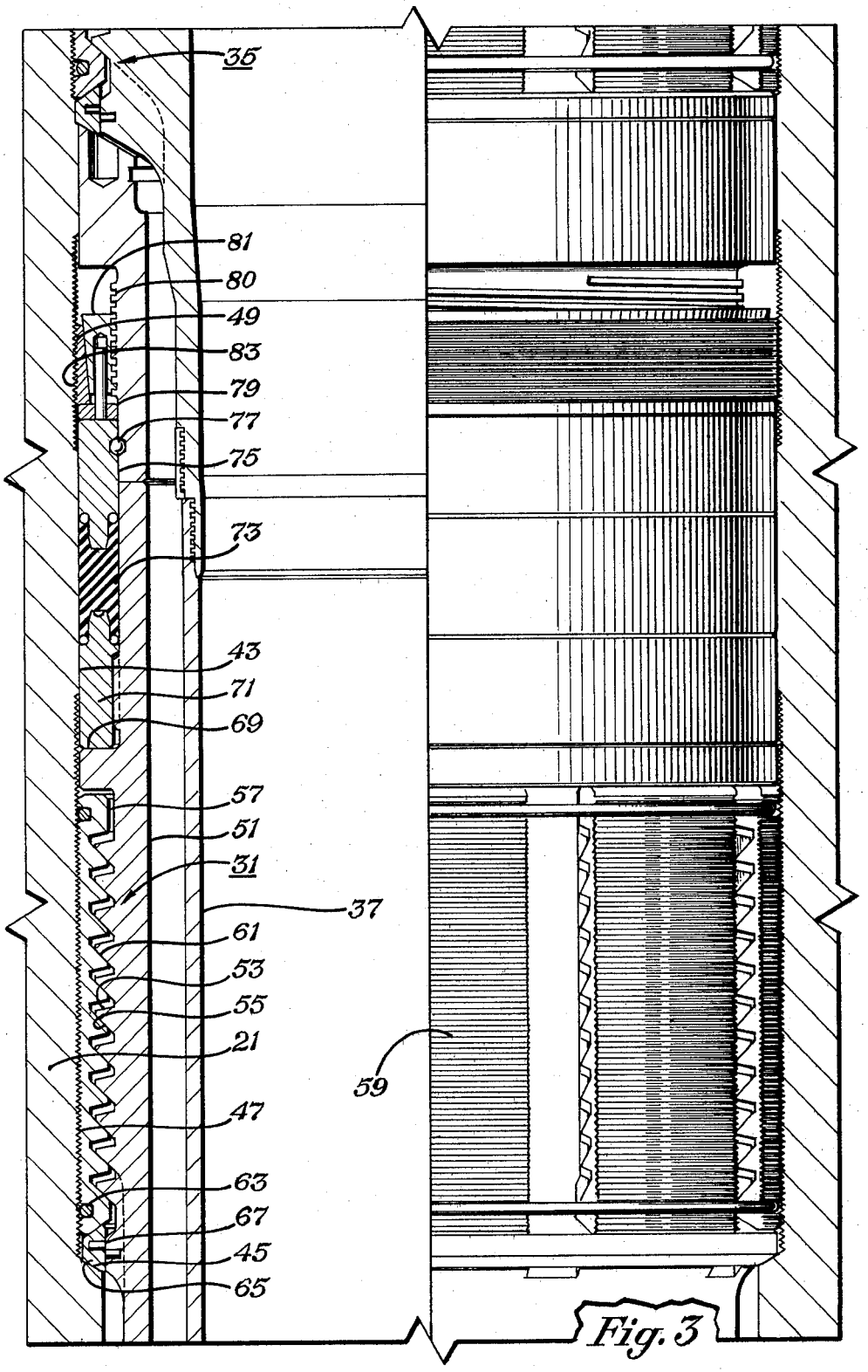
FIG. 3 is a view of the casing hanger of FIG. 2, shown after setting.

The larger casing hanger 31 and the smaller casing hanger 35 are independently secured to the support or wellhead 21 as best shown in FIG. 3. The wellhead 21 has a bore 43 extending through it. An annular, upwardly facing seat or shoulder 45 is located in wellhead 21. A lower set of wicker grooves or wickers 47 are formed immediately above shoulder 45 in the bore 43 of wellhead 21. Wickers 47 are small, parallel grooves extending circumferentially around the bore 43 perpendicular to the axis of the bore 43. An upper set of wicker grooves 49 are spaced a short distance above the lower wickers 47. Wickers 47 and 49 preferably have a pitch of about eight per inch. Also preferably the upper and lower side of each groove of wickers 47 and 49 are of the same length and of opposite inclination.

The casing hanger 31 includes an inner tubular member 51. Inner member 51 has on its outer wall a set of reacting grooves 53 formed therein. Reacting grooves 53 are parallel grooves that are formed perpendicular to the axis of the inner member, which coincides with the axis of the bore 43. The depth of each reacting groove 53 is several times the depth of wicker grooves 47, and the pitch or distance between grooves is much greater, less than two per inch, for example. Each reacting groove 53 is generally sawtooth in configuration. The lower side of each reacting groove 53 is an inclined surface 55 that faces downwardly and outwardly at about a 45 degree angle with respect to the axis of bore 43. The upper side of each reacting groove 53 forms about a 20 degree angle with respect to the axis of bore 43.

The inner member 51 carries around its outer surface a plurality of locking segments or slips 57. Slips 57 are spaced apart from each other and extend circumferentially around the outer wall of inner member 51. Each slip 57 is a segment of a cylinder, having curved inner and outer walls and of uniform thickness. A plurality of wicker grooves or wickers 59 are formed on the outer wall of each slip 57. Wickers 59 are parallel grooves identical to wickers 47. The inner wall of each slip 57 contains reacting grooves 61 that are identical to the reacting grooves 53 of the inner member.

Figure 2:
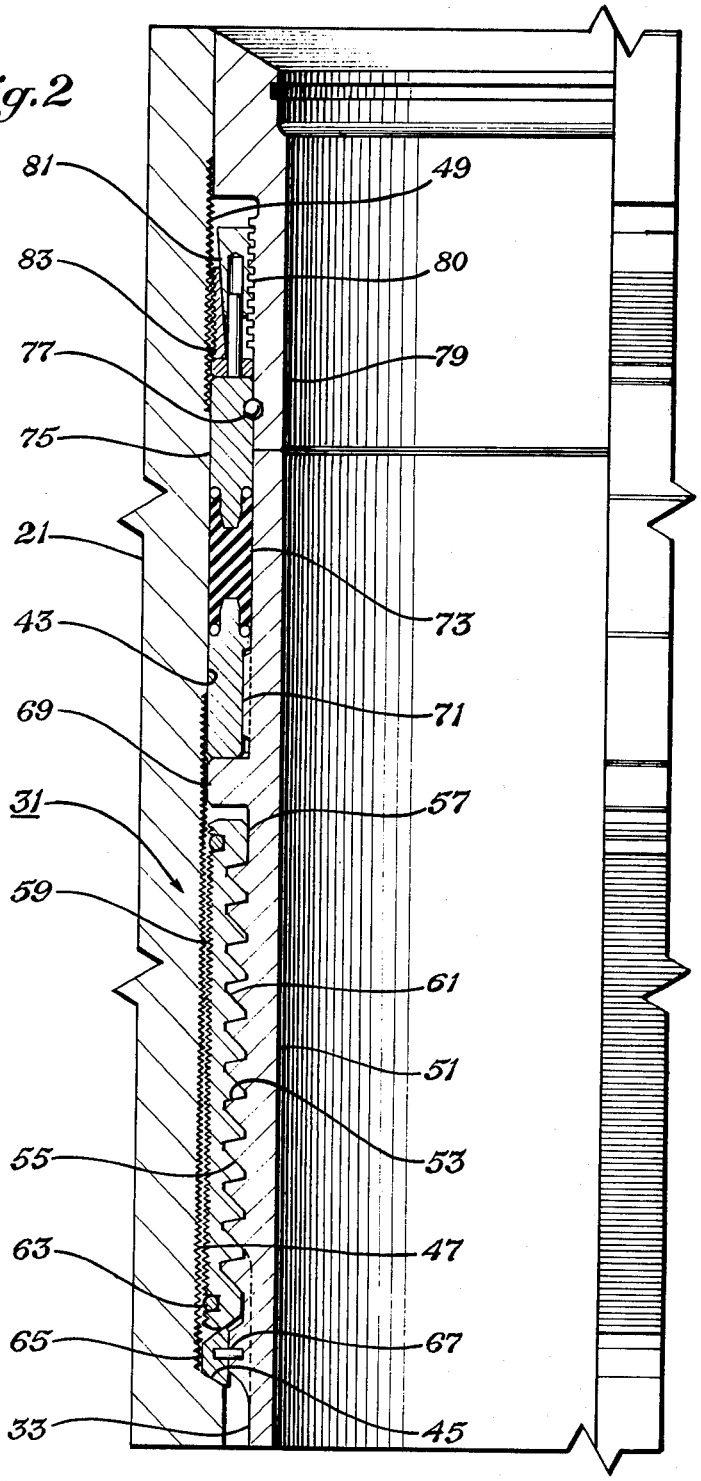
FIG. 2 is an enlarged sectional view of one of the casing hangers of FIG. 1, but shown prior to setting.

Slips 57 will move laterally between a contracted position shown in FIG. 2 to an expanded position in which the wickers 47 and 59 engage each other. Spring retainer rings 63 encircle the slips 57 near the top and near the bottom to urge the slips back into the contracted position. A wedge ring 65 is located at the bottom of the slips 57. Wedge ring 65 has an upper inclined surface or frusto-conical surface that is oriented at about 45 degrees with respect to the axis of bore 43. The lower surface of wedge ring 65 is also tapered or inclined, for mating flush with the shoulder 45 in the wellhead 21. A shear pin 67 retains wedge ring 65 in a lower position. When setting, as shown in FIG. 3, shear pin 67 is sheared by the weight imposed on the inner member 51. This moves the wedge ring 65 upward, urging the slips 57 outward to engage the wickers 47.

The casing hanger 31 also includes a seal means for pressure sealing the annular space between the inner member 51 and the bore 43. An annular flange 69 is formed on inner member 51 above slips 57. A lower metal ring 71 is carried above flange 69. An elastomeric seal ring 73 is located above the metal ring 71. An upper metal ring 75 is located above seal ring 73. The upper metal ring 75 has a groove that mates with a groove in a rotatable drive member 79, defining a cavity containing a plurality of balls 77. Drive member 79 is concentric with the inner member 51 and is adapted to receive a setting tool (not shown) when the casing hanger 31 is to be sealed. Drive member 79 has threads 80 on its exterior which engage threads on a locking ring 81. Rotation of the drive member 79 causes the locking ring 81 to move downward, wedging outward a wedge ring 83. Wedge ring 83 has wickers on its exterior that engage the upper set of wickers 49 to lock the seal ring 73 in sealing engagement.

The smaller casing hanger 35 has identical locking means to the larger diameter casing hanger 31. It contacts the upper edge of the drive member 79, which serves as a landing shoulder or seat to cause the slips of casing hanger 35 to move outward, in the same manner as the annular shoulder 45, previously discussed. In the embodiment shown in FIG. 1, the smallest diameter hanger 39 is supported on casing hanger 35, and does not use the locking means previously described.

In the operation of the embodiment of FIG. 1, to install casing hanger 31, casing 33 is secured to the bottom of the casing hanger inner member 51, and the assembly is lowered into the well. The slips 57 will be in a contracted position as shown in FIG. 2, with a clearance existing between wickers 47 and 59. Once the wedge ring 65 contacts the shoulder 45, shear pin 67 shears and slips 57 will move outward, causing the wickers 59 to engage the wickers 47. Downward force imposed on the inner member 51 causes a resultant force that acts downwardly and outwardly along a 45 degree line with respect to the axis of bore 43, due to the engagement of the reacting grooves 53 and 61. The resultant force urges the slips 57 into locking engagement with wickers 47.

Cement is pumped down casing 33 to return up the space between the wellbore and casing 33 for cementing the casing in place. Drilling mud displaced by the cement flows between wellhead 21 and spaces between slips 57 to return through the risers to the surface. Once the cement has hardened, the seal assembly, including rotatable member 79 and rings 71, 75 and 83, is secured to a setting tool and lowered into engagement with inner member 51.

Seal ring 73 is set by applying downward force to the rotatable member 79, which deforms the seal ring 73 through the interaction with upper metal ring 75 and ball 77. Rotation of the drive member 79 moves the locking ring 81 downward to urge wedge ring 83 outward to lock the seal ring 73 in the deformed position. This position is shown in FIG. 3. A drill bit will then be lowered through casing 33 for further drilling. The smaller casing hanger 35 will be set in the same manner.

Figure 4:
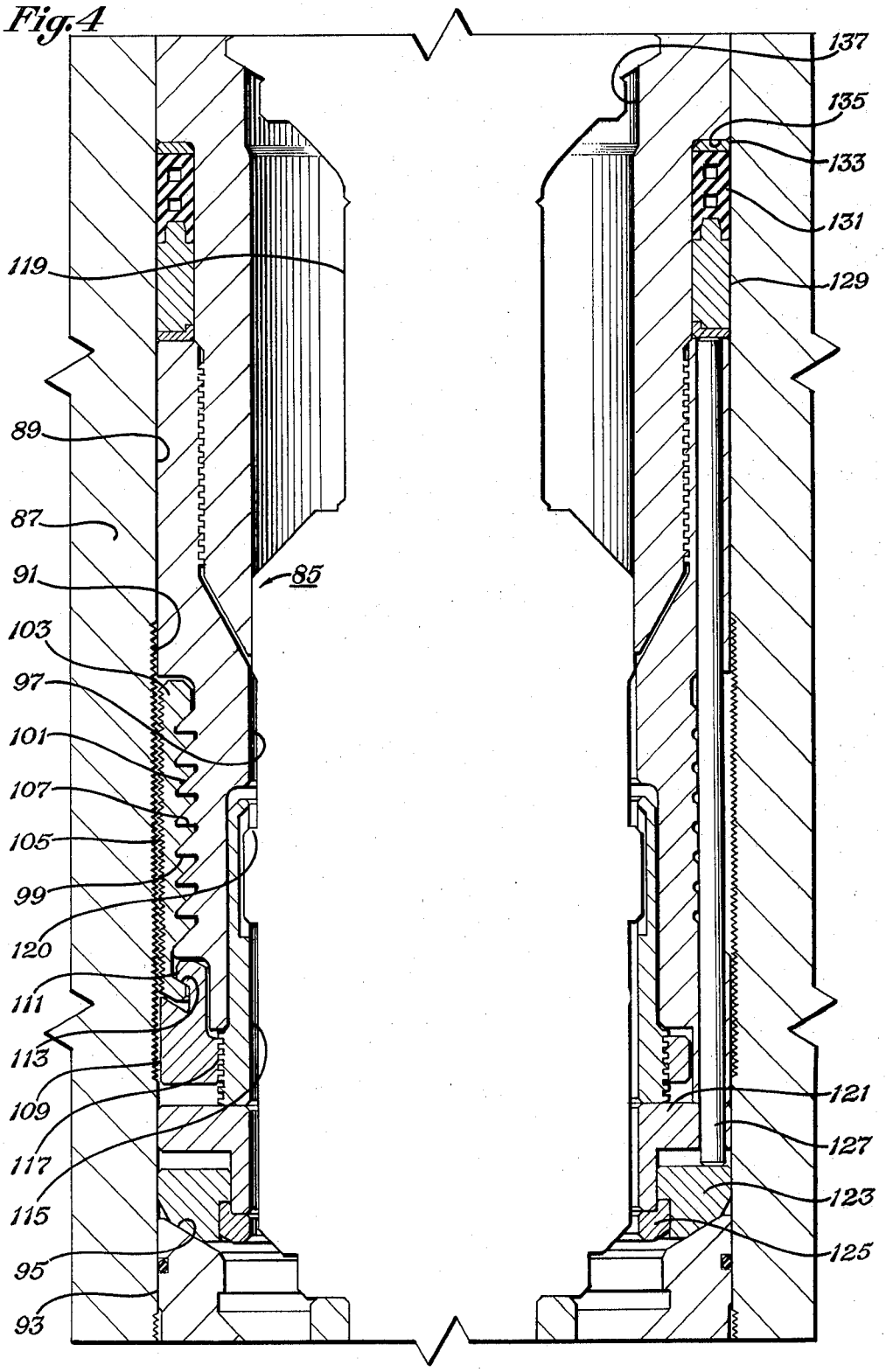
FIG. 4 is a sectional view of a portion of a stub housing mounted within a wellhead housing in accordance with this invention, and shown prior to setting.
Figure 5:
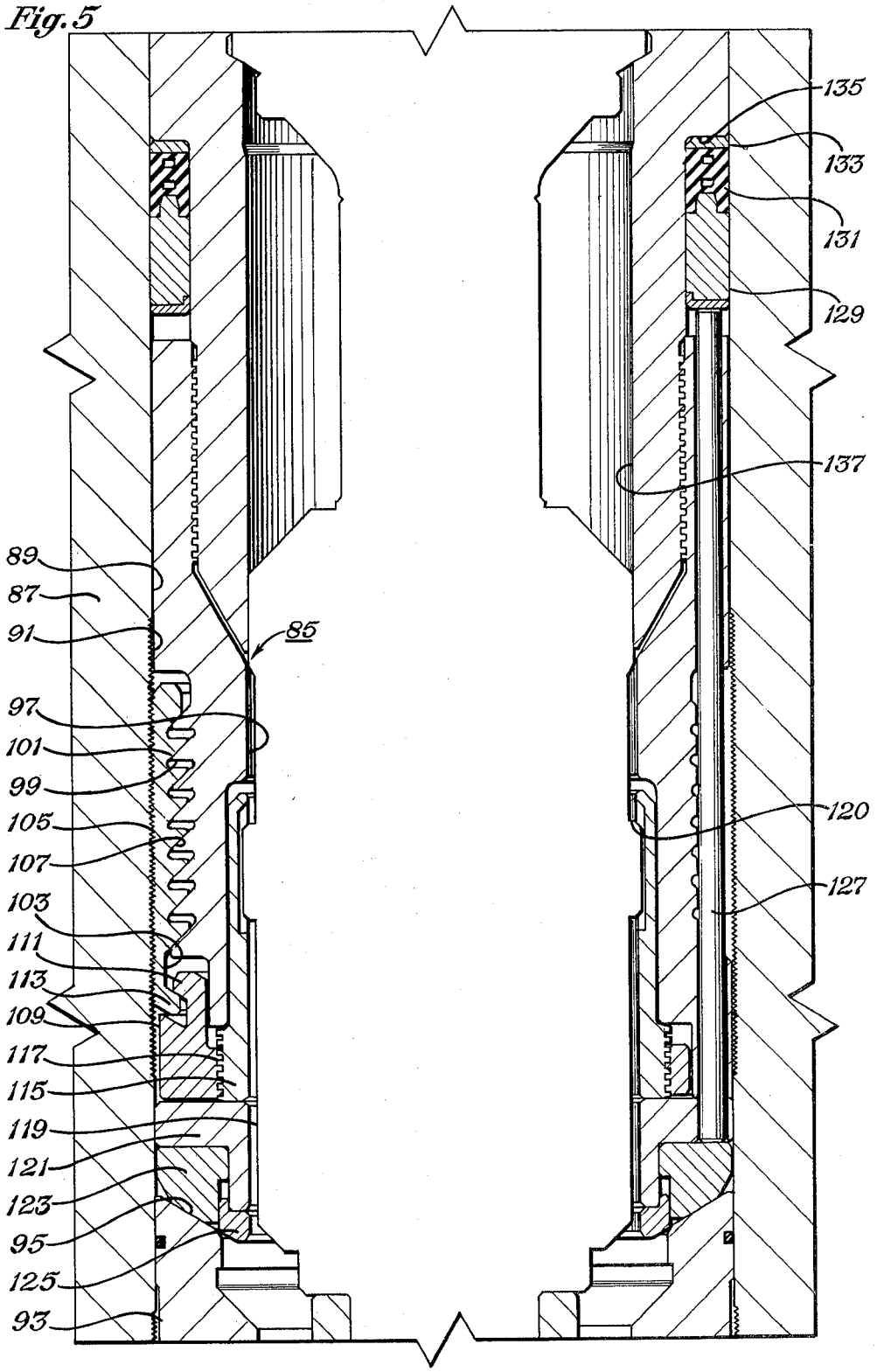
FIG. 5 is a sectional view of the portion of the stub housing of FIG. 4, but shown after setting.

The locking means of a second embodiment is shown in FIGS. 4 and 5. This locking means is used to lock a stub housing 85 into a wellhead housing 87. Stub housing 85 is a tubular member that extends upwardly from a wellhead housing 87. Stub housing 85 is used to reduce the effective diameter of the wellhead housing 87 to increase the pressure rating. Stub housing 85 does not have casing secured to its lower end, rather serves as a wellhead itself to support casing hangers within. Since there is no casing cemented in the well and secured to stub housing 85, internal pressure within stub housing 85 tends to push the stub housing 85 upward from the support or wellhead housing 87. The locking means is used to prevent this upward movement.

Wellhead housing 87 contains an axial bore 89. Bore 89 has formed therein a plurality of wicker grooves or wickers 91. Wickers 91 are identical to the wickers 47 of the casing head 21 of FIGS. 2 and 3. Wickers 91 are small sawtoothed grooves extending parallel to each other perpendicular to the axis of the bore 89. A spacer 93 rests on a shoulder (not shown) within the bore 89 and has an inclined seat or shoulder 95 on its upper end. The locking means includes an inner member 97 that is tubular and has an outer wall containing reacting grooves 99. Reacting grooves 99 are much larger in size than the wicker grooves 91. Each reacting groove 99 extends circumferentially around the outer wall perpendicular to the axis of bore 89. Each reacting groove 99 has an upper side containing an inclined surface 101 that faces upwardly and outwardly at an angle of 45 degrees with respect to the axis of bore 89. The lower side of each reacting groove 99 is located in a plane that is perpendicular to the axis of bore 89. Reacting grooves 99 are the same as reacting grooves 53 of FIGS. 2 and 3, but inverted.

A plurality of locking segments or slips 103 are carried around the outer wall of the inner member 97. Each slip 103 is a rectangular, spaced-apart element that is a segment of a cylinder of uniform thickness. The inner side and the outer side of each slip 103 are curved. The outer side contains a plurality of wicker grooves or wickers 105 that are identical to the wickers 91 formed in the bore 89. The inner side of each slip 103 contains reacting grooves 107 that are identical to the reacting grooves 99 formed on the outer wall of the inner member 97. As shown by comparing FIGS. 4 and 5, the slips 103 will move between a contracted unlocked position shown in FIG. 4 to an expanded locking position shown in FIG. 5, with the wickers 91 and 105 engaging each other.

A linkage member 109 is carried by the inner member 97 below the slips 103 for serving as expansion means to move the slips between the contracted position and the expanded position. Linkage member 109 is annular and contains a plurality of spaced-apart upper lips 111. Each lip 111 extends outwardly over and engages a downwardly and inwardly extending lug 113 formed on each slip 103. Lip 111 and lug 113 serve as wedge means for moving slips 103 outward as the linkage member 109 moves downward.

A rotatable drive member 115 is carried on the inner side of inner member 97 for moving the linkage member 109 between the upper position shown in FIG. 4 and the lower position shown in FIG. 5. Drive member 115 has threads 117 on its exterior that engage threads on the exterior of linkage member 109. A setting tool 119 is adapted to be placed inside the inner member 97 for rotating the drive member 115 to set the locking means. Setting tool 119, is of a conventional nature and is only shown in outline. It is of a type that has hydraulically driven retractable dogs 120 that engage slots in the drive member 115 to cause it to rotate as the setting tool 119 is rotated.

The stub housing locking means of FIGS. 4 and 5 also has seal means for sealing the stub housing 85 to the wellhead housing 87. The seal means includes on the lower end a flange 121 that is rigidly secured to the body of the inner member 97. A collar 123 is carried below flange 121 and retained by the retainer ring 125. Collar 123 has a lower frusto-conical surface that engages the shoulder 95 of the spacer 93. As shown by comparing FIGS. 4 and 5, collar 123 will move between a lower position prior to setting to an upper position when set.

As the collar 123 moves upward when contacting shoulder 95, it moves a plurality of rods 127 upward. Rods 127 are cylindrical members located in longitudinal passages extending around the inner member 97. A rod 127 is located between each slip 103. Rods 127 also extend through passages in flange 121. A two-piece metal ring 129 is located in engagement with the tops of the rods 127. Metal ring 129 extends around the inner member 97 in a recess. An elastomeric seal ring 131 is located above the metal ring 129. An upper metal ring 133 is located above the seal ring 131 and is adapted to contact a shoulder 135 formed in an upper section 137 of inner member 97. Rods 127 serve as compression means to push upwardly against seal ring 131 when a downward force is imposed on inner member 97 before setting slips 103.

In the operation of the second embodiment shown in FIGS. 4 and 5, the stub housing 85 is lowered into the wellhead housing 87 on a setting tool 119. When collar 123 contacts shoulder 95, it will move upward, causing rods 127 to move upward, deforming seal ring 131, as shown in the sequence between FIGS. 4 and 5. Then, the setting tool 119, through dogs 120, rotates the drive member 115. This causes the linkage member 109 to move downwardly. The linkage member 109 moves the slips 103 outward, causing wickers 105 to engage wickers 91. The tight engagement causes the seal ring 131 to remain deformed. Upward force imposed on the inner member 97 due to high pressure in the wellhead housing 87 is resisted by the reacting grooves 99 and 107. A resultant force of an upward axial force acts outwardly on the slips 103, causing even tighter engagement with the wickers 91.

The invention has significant advantages. The locking means allows one to tightly secure an inner member to a tubular outer member, utilizing only wicker grooves and a single landing seat in the bore of the outer member. This enables one to independently support a smaller casing hanger above a larger diameter casing hanger such that force imposed on the smaller casing hanger is not imposed on the larger diameter casing hanger and the landing shoulder. The locking means also provides an effective means to lock a stub housing in a wellhead to resist upward force.

While the invention has been shown in only two of its forms, it should be apparent to those skilled in the art that it is not so limited but is susceptible to various changes without departing from the scope of the invention.

I claim:

1. In a well assembly having an outer member with an axial bore containing an upwardly facing shoulder, a hanger having a string of pipe secured to a lower end, an improved means for supporting the hanger in the outer member, comprising in combination:

a plurality of annular wicker grooves formed in the sidewall of the bore perpendicular to the axis of the bore;

a plurality of reacting grooves formed in an outer wall of the hanger, each reacting groove extending at least partially around the circumference of the outer wall and perpendicular to the axis of the hanger;

a plurality of slips spaced circumferentially apart from each other around the outer wall of the hanger, each slip having an outer wall with wicker grooves adapted to mate with the wicker grooves of the bore, and an inner wall containing reacting grooves that mate with the reacting grooves of the hanger; and expansion means for moving the slips between a contracted position in which a clearance exists between the wicker grooves of the bore and slips to an expanded position in which the wicker grooves of the bore and slips engage each other, the expansion means being actuated by contact with the shoulder and downward force applied to the hanger;

the reacting grooves of the hanger each having an inclined surface facing downwardly and outwardly;

the reacting grooves of the slips having oppositely facing inclined surfaces that engage the inclined surfaces of the hanger in both the contracted and expanded positions and slide outwardly with respect to the inclined surfaces of the hanger in the expanded position;

in the expanded position, the force acting on the hanger being resisted by a reaction between the inclined surfaces, which directs an outward resultant force to the slips.

2. In a well assembly having a wellhead with an axial bore containing an upwardly facing shoulder, an improved means for supporting a casing hanger in the wellhead, the casing hanger being mounted to the top of a string of casing and comprising in combination:

a plurality of annular wicker grooves formed in the wellhead bore above the shoulder;

a plurality of reacting grooves formed on an inner member of the casing hanger, each reacting groove extending at least partially around the circumference of the inner member and perpendicular to the axis of the inner member, each reacting groove having an inclined surface facing downwardly and outwardly;

a plurality of slips spaced circumferentially apart from each other around the inner member, each slip having an outer wall with wicker grooves adapted to mate with the wicker grooves of the bore, and an inner wall containing reacting grooves, each slip reacting groove having an inclined surface that faces inwardly and upwardly for slidingly engaging the inclined surface of the reacting grooves of the inner member;

wedge means having a lower surface adapted to contact the wellhead shoulder and an upper inclined surface adapted to contact lower edges of the slips, for pushing the slips outward into engagement with the wicker grooves of the bore as a downward force is applied to the casing hanger, the downward force causing the reacting grooves of the casing hanger to maintain the slips in engagement with the wicker grooves of the bore to support the casing hanger; and seal means for pressure sealing the inner member to the bore of the wellhead.

3. A locking means for securing an inner member within a bore of an outer member of a well assembly to resist upward movement of the inner member, comprising:

a plurality of circumferential wicker grooves formed in the bore transverse to the axis of the bore;

a plurality of reacting grooves formed on an outer wall of the inner member and extending perpendicular to the axis of the inner member, each reacting groove having an upwardly and outwardly facing inclined surface;

a plurality of slips spaced around the outer wall of the inner member, each slip having an outer wall with wicker grooves adapted to mate with the wicker grooves of the bore, and an inner wall containing a plurality of reacting grooves, each slip reacting groove having an inclined surface that faces inwardly and downwardly for slidingly engaging the inclined surface of the reacting grooves of the inner member; and expansion means for moving the slips from a contracted position in which the wicker grooves of the slips are spaced inward of the wicker grooves of the bore, to an expanded position in which the wicker grooves of the slips and bore engage each other and the reacting grooves of the slips and inner member continue to engage each other to resist upward force as the reacting grooves of the inner member push upwardly and outwardly against the reacting grooves of the slips due to high internal pressure in the inner member.

4. A locking means for securing an inner member within a bore of an outer member of a well assembly to resist upward movement of the inner member, comprising:

a plurality of circumferential wicker grooves formed in a sidewall of the bore transverse to the axis of the bore;

a plurality of reacting grooves, having greater pitch than the pitch of the wicker grooves, formed on an outer wall of the inner member and extending perpendicular to the axis of the inner member, each reacting groove having an upwardly and outwardly facing inclined surface;

a plurality of slips spaced around the outer wall of the inner member, each slip having an outer wall with wicker grooves adapted to mate with the wicker grooves of the bore, and an inner wall containing a plurality of reacting grooves, each slip reacting groove having an inclined surface that faces inwardly and downwardly for slidingly engaging the inclined surface of the reacting grooves of the inner member;

a linkage member rotatably mounted to the outer wall of the inner member below the slips, the linkage member having a threaded inner diameter;

a drive member rotatably carried by the inner member and having a threaded exterior engaging the threaded interior of the linkage member, the drive member having an interior adapted to receive a rotatable setting tool for rotating the drive member; and wedge means formed on the linkage member and lower ends of the slips for moving the slips outward to engage the wicker grooves of the outer member bore as the linkage member moves downward due to rotation of the drive member by the setting tool.

5. A locking means for securing an inner member within a bore of an outer member of a well assembly to resist upward movement of the inner member, comprising:

a plurality of circumferential wicker grooves formed in the bore transverse to the axis of the bore;

a plurality of reacting grooves formed on an outer wall of the inner member and extending perpendicular to the axis of the inner member, each reacting groove having an upwardly and outwardly facing inclined surface;

a plurality of slips spaced around the outer wall of the inner member, each slip having an outer wall with wicker grooves adapted to mate with the wicker grooves of the bore, and an inner wall containing a plurality of reacting grooves, each slip reacting groove having an inclined surface that faces inwardly and downwardly for slidingly engaging the inclined surface of the reacting grooves of the inner member;

an annular elastomeric seal ring extending around the inner member; and setting means for moving the slips and seal ring from a contracted position in which the wicker grooves of the slips are spaced inward of the wicker grooves of the bore and the seal ring is movable with respect to the bore, to an expanded position in which the wicker grooves of the slips and bore engage each other and the seal ring seals against the bore;

the reacting grooves of the inner member continuing to engage the reacting grooves of the slips in the expanded position to transmit upward force on the inner member through the inclined surfaces to the outer member.

6. A locking means for securing an inner member within a bore of an outer member of a well assembly to resist upward movement of the inner member, comprising:

a plurality of circumferential wicker grooves formed in the bore transverse to the axis of the bore;

a plurality of reacting grooves formed on an outer wall of the inner member and extending perpendicular to the axis of the inner member, each reacting groove having an upwardly and outwardly facing inclined surface;

a plurality of slips spaced around the outer wall of the inner member, each slip having an outer wall with wicker grooves adapted to mate with the wicker grooves of the bore, and an inner wall containing a plurality of reacting grooves, each slip reacting groove having an inclined surface that faces inwardly and downwardly for slidingly engaging the inclined surface of the reacting grooves of the inner member;

an annular elastomeric seal ring located in an annular cavity extending around the inner member;

compression means for pushing upwardly against the seal ring to a sealed position for sealing against the bore in response to a downward force imposed on the inner member;

expansion means for moving the slips from a contracted position in which the wicker grooves of the slips are spaced inward of the wicker grooves of the bore, to an expanded position in which the wicker grooves of the slips and bore engage each other, and for retaining the seal ring in the sealed position;

the reacting grooves of the inner member continuing to engage the reacting grooves of the slips in the expanded position to transmit upward force on the inner member through the inclined surfaces to the outer member.

7. A locking means for securing an inner member within a bore of an outer member of a well assembly to resist upward movement of the inner member, comprising:

a plurality of circumferential wicker grooves formed in a sidewall of the bore transverse to the axis of the bore and spaced above an upwardly facing shoulder located in the bore;

a plurality of reacting grooves formed on an outer wall of the inner member and extending perpendicular to the axis of the inner member, each reacting groove having an upwardly and outwardly facing inclined surface;

a plurality of slips spaced around the outer wall of the inner member, each slip having an outer wall with wicker grooves adapted to mate with the wicker grooves of the bore, and an inner wall containing a plurality of reacting grooves, each slip reacting groove having an inclined surface that faces inwardly and downwardly for slidingly engaging the inclined surface of the reacting grooves of the inner member;

an annular elastomeric seal ring located in an annular cavity extending around the inner member above the slips;

a metal ring carried in the cavity below the seal ring;

a linkage member rotatably mounted to the outer wall of the inner member below the slips, the linkage member having a threaded inner diameter;

a drive member rotatably carried by the inner member and having a threaded exterior engaging the threaded interior of the linkage member, the drive member having an interior adapted to receive a rotatable setting tool for rotating the drive member; and wedge means formed on the linkage member and the slips for moving the slips outward to engage the wicker grooves of the outer member bore as the linkage member moves downward due to rotation of the drive member by the setting tool;

a collar carried by the inner member below the linkage member and movable with respect to the inner member between a lower position prior to setting the inner member and an upper position in contact with the shoulder in the bore; and a plurality of rods extending between the top of the collar and the bottom of the metal ring, for pushing upwardly against the seal ring to cause the seal ring to seal against the bore when the collar is in the upper position.

* * * * *